United States Patent [19]

Lorson et al.

[11] 4,349,936

[45] Sep. 21, 1982

[54] AGITATOR FOR A CLEANER OR THE LIKE

[75] Inventors: Emmett D. Lorson, Canton; Keith G. Minton, North Canton, both of Ohio

[73] Assignee: The Hoover Company, North Canton, Ohio

[21] Appl. No.: 238,051

[22] Filed: Feb. 25, 1981

[51] Int. Cl.[3] ..... A47L 5/30

[52] U.S. Cl. ..... 15/366; 15/5; 15/374

[58] Field of Search ..... 15/5, 90, 141, 141 A, 15/364, 366, 374

[56] References Cited

U.S. PATENT DOCUMENTS

| | | | |
|---|---|---|---|
| 1,957,506 | 5/1934 | Smellie | 15/366 |
| 2,130,635 | 9/1938 | Dow et al. | 15/374 X |
| 2,310,267 | 2/1943 | Taylor | 15/366 X |
| 3,716,889 | 2/1973 | Goldstein | 15/366 |
| 3,737,937 | 6/1973 | Nordeen | 15/366 X |
| 4,209,873 | 7/1980 | Schaefer | 15/366 X |

*Primary Examiner*—Chris K. Moore

*Attorney, Agent, or Firm*—Gerald H. Kreske; Richardson B. Farley

[57] ABSTRACT

An agitator roll for a floor care appliance or the like is disclosed having short, angled beater bars. The agitator may be of foamed plastic.

10 Claims, 6 Drawing Figures

AGITATOR FOR A CLEANER OR THE LIKE

BACKGROUND OF THE INVENTION

1. Field of the Invention

The invention relates to floor care appliances or the like and, more specifically, relates to a particularized agitator for such a floor care appliance.

2. Summary of the Prior Art

Unitary molded plastic agitators for use with floor care appliances or the like are not shown heretofore to our knowledge with molded in beater bars that positively tend to urge the floor or floor covering dirt towards the suction duct for the floor care appliance. Obviously, the furnishing of a molded plastic agitator would be advantageous, while the presence of beater bars angled for dirt urging on any agitator would aid in the efficient pickup of dirt by the floor care appliance.

Accordingly, it is an object of the invention to provide a unitary molded plastic agitator with integral beater bars.

It is a further object of the invention to form beater bars angled relative to the vertical to tend to work the floor covering and entrapped dirt.

It is a still further object of the invention to angle the beater bars towards the suction duct to aid in moving dirt in that direction.

It is an even further object of the invention to provide brush rows which cooperate with the beater bars in their dirt urging function.

SUMMARY OF THE INVENTION

The present invention has as its principle object the provision of a new agitator arrangement in a cleaner which can be made of plastic and easily molded so as to provide a relatively inexpensive replaceable agitator for a floor care appliance. According to the present invention, a plastic molded agitator is provided having integrally molded beater bars and a lanced arrangement for mounting brush tufts, disposed between the beater bars. The beater bars comprise a series of short stubby protrusions extending from the general overall face of the agitator and angled obliquely relative to the agitator roll axis and spiralling in a screw-like fashion to provide for easy moldability and, at the same time, tending to limit the noise generated by the use of a beater bar arrangement on an agitator. The angular positioning of the beater bars also works against the floor covering in a transverse direction relative to agitator rotation. The brush strips are arranged in a helix fashion and in a chevron pattern with the helix being relatively steep to insure a maximum amount of brush area on the carpet at one time to prevent the brushes acting as beater bars and generating unwanted noise. These brush strips ideally take the form as an offset chevron relationship adjacent the duct suction opening to the cleaner, to tend to move dirt to this opening and to permit easy placement of the beater bars on the agitator cylinder. The beater bars all along the agitator surface are also angled towards the duct suction opening so as to tend to move dirt in the carpet along towards it as does the offset chevron brush arrangement.

Reference may now be had to the accompanying drawings for a better understanding of the invention, both as to its organization and function, with the illustration being only exemplary, and in which.

DETAILED DESCRIPTION OF THE INVENTION

Figure 3:
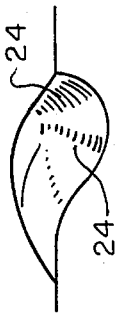
FIG. 3 is a perspective end view of one of the beater bars of our invention.
Figure 2:
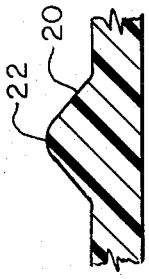
FIG. 2 is a cross section of a beater bar taken on line A—A of FIG. 1.
Figure 1:
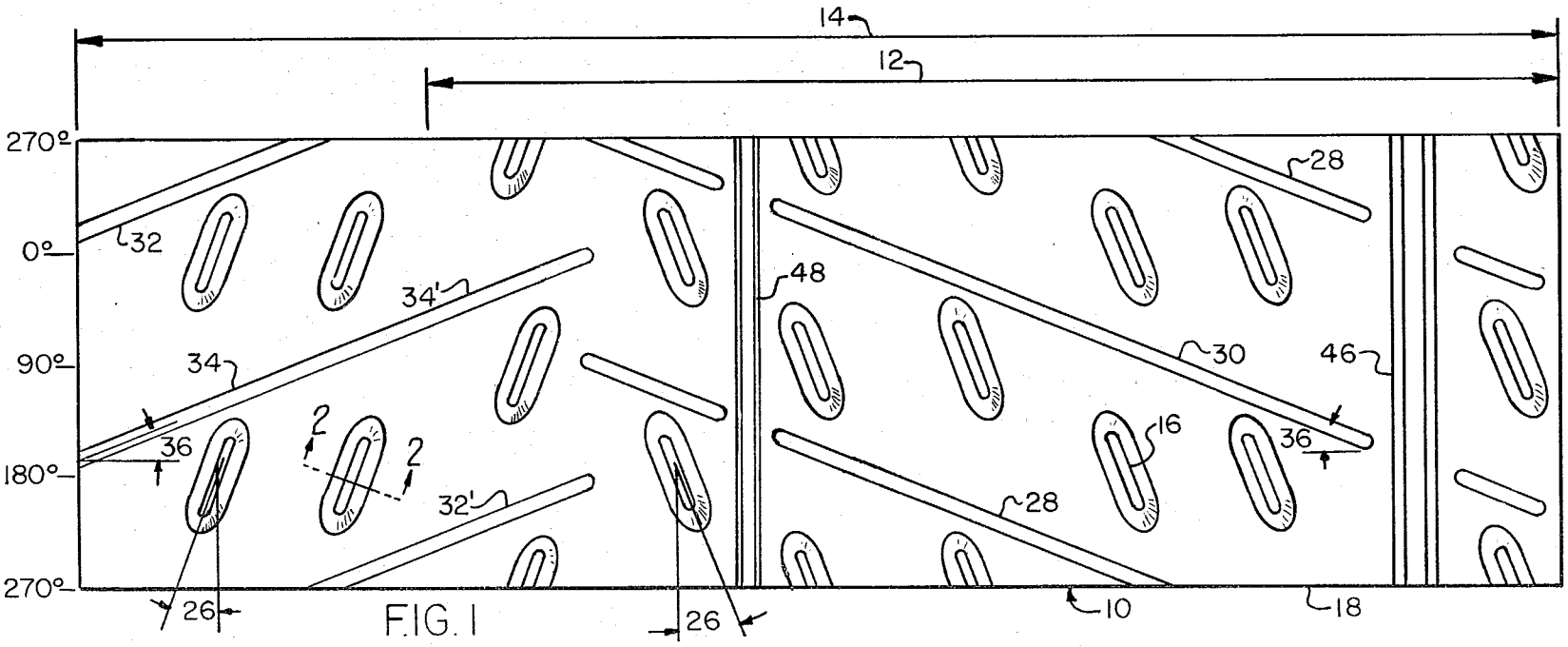
FIG. 1 is a plan view of a developed agitator body surface embodying the invention.

In FIG. 1 it is seen that there is a developed agitator, body surface 10 which includes in its showing a short agitator 12 indicated by dimension lines and a longer agitator 14 also indicated by dimension lines. These agitators can preferably be molded from foamed plastic such as polypropylene. In each of the agitators it can be seen that a series of beater bars 16, 16 are disposed obliquely relative to the axis of the agitator roll some in paired configuration to increase beater bar area and still permit moldability. These beater bars are relatively short and are molded integrally into the agitator body 18 (FIGS. 2 and 3) and have a truncated triangular cross section 20 with a slightly curved top 22. The ends of each of the beater bars 16 are equally curvilinear in nature having curvilinear sides 24, 24 to furnish a finalized smooth contour.

Short beater bars were selected over elongated bars because of the general molding considerations. The beater bars 16, 16 are also obliquely angulated relative to the agitator roll axis rather than placed parallel thereto since a similar noise effect occurs with parallel thereto positioning. Also, although beater bars exactly perpendicular to the agitator roll axis would generate low noise they would do very little working action on the rug so an angular positioning of the beater bar 16 was selected as ideal. This angle can be best defined by an angle 26 of 20° to 25° from the circumference since this permits molding of the agitator body 18 but still provides a working action of the beater bars 16 in the rug or floor covering.

Figure 4:
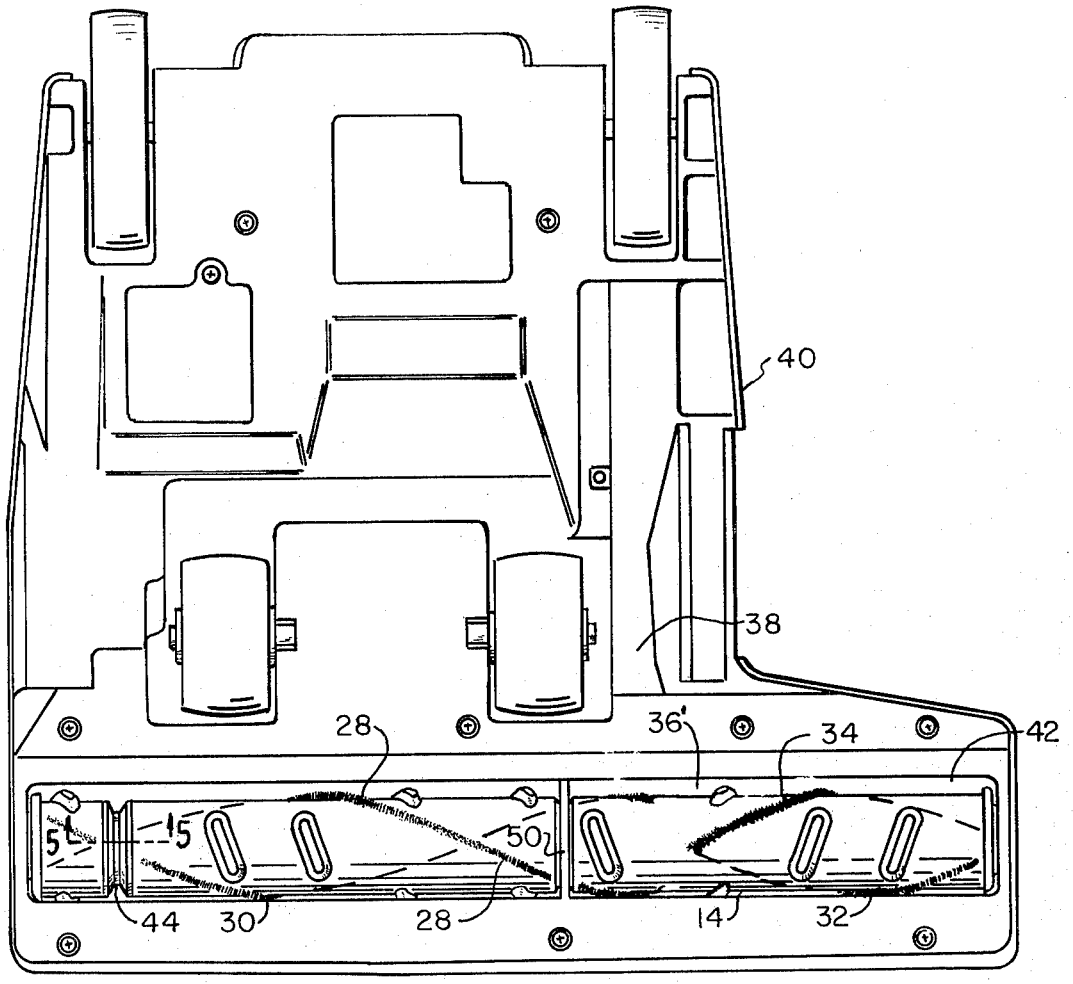
FIG. 4 is a bottom plan view of a cleaner main body showing the elongated agitator of the invention in operative position.

A series of brush strips 28, 30, 32 and 34 (elongated agitator 14) are disposed on the agitator body surface 10, with these brush strips taking an angle 36 of 20° to 26° to the axis of the body to provide a spiral of some steepness to insure that a relatively large amount of brush strip is on the floor at any one time. This limits the beater bar action of these brush strips and lessens the noise generated by the agitator. The brush strips 28, 30, 32 and 34 are arranged in a chevron pattern in that the brush strips 28 and 32 tend to peak along the agitator body 10 and similarly brush strips 30 and 34 also tend to peak. This can be seen in FIG. 4 wherein the brush strips 28 and 30 peak along their spiralling path on the elongated agitator 14 and the brush strips 32 and 34 also peak. In the short agitator 12, the brush strips 28 and 30 also peak along their spiralling path while the brush strips 32' and 34' while even of abbreviated length tend to provide a chevron design along their spiral.

The brush strips 28 and 30 are offset respectively, from the brush strip 32 or brush strip 32' and the brush strip 34 or brush strip 34', generally at a suction opening 36 of the cleaner leading from a duct 38 in a cleaner body 40. The duct 38, of course, leads to a motor-fan system (not shown) to proide suction to the opening 36′ when the agitator 12 or agitator 14 is disposed in an agitator chamber 42 or agitator chamber 42′ in the main body 40 or main body 40′, respectively. With, essentially, a peak of the chevron design (offset) of the brush strips of the agitators 12 and 14 located at the suction opening 36, there is a tendency for dirt to be moved along the rug or floor covering surface as the agitator 12 or 14 rotates during the cleaning process towards the suction opening 36. This aids in the cleaning function for the cleaner for which agitator 12 or agitator 14 is a sub-assembly. At the same time, the offset of the chevron tends to permit easy location of the short beater bars 16, on the long portion of the agitator 12 or the agitator 14, angled towards the suction opening and with the beater bars 16 on the short portion of the agitator 12 or the agitator 14 also angled towards the suction opening. Again this tends to screw or move the dirt and entrained debris in the rug or floor covering being cleaned towards the suction opening 36.

Figure 5:
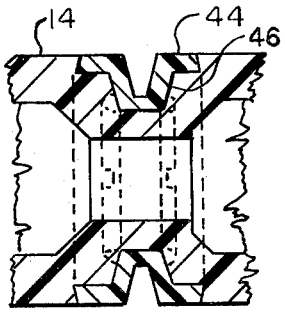
FIG. 5 is a cross sectional view of the pulley section, around which the agitator of the invention is molded.
Figure 6:
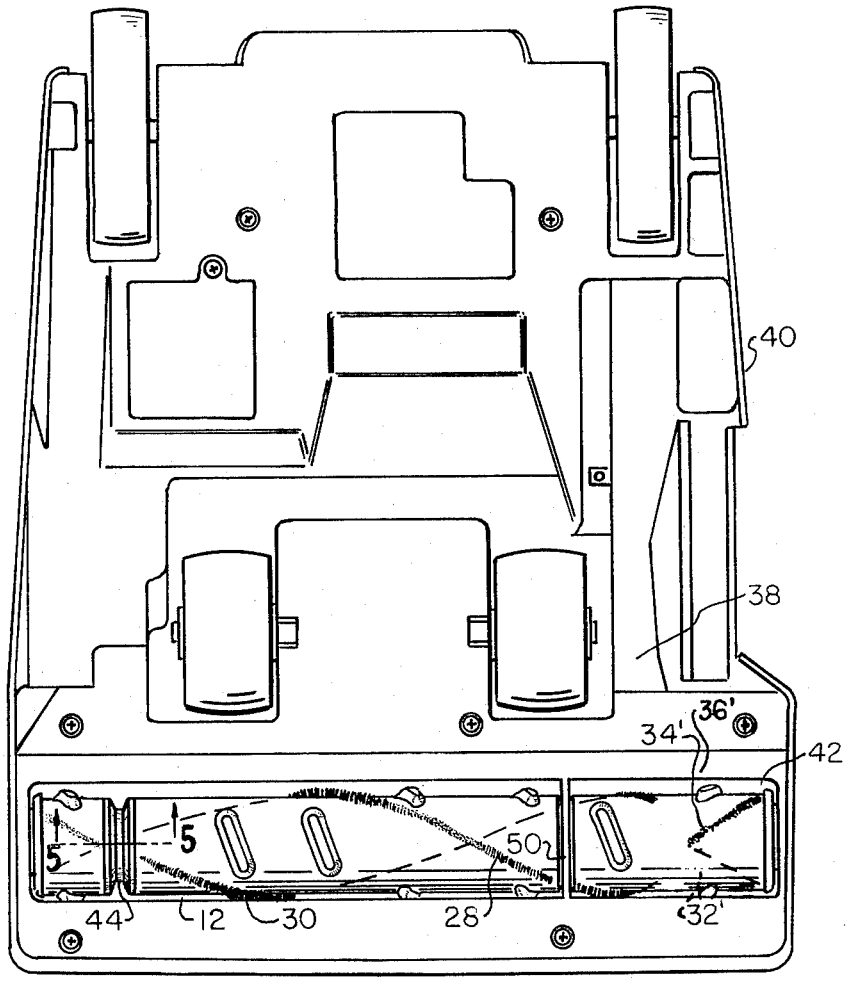
FIG. 6 is a similar viewing of a shortened agitator in operative position.

A pulley section 44 (FIG. 5) is formed as a molded part and integrated into the agitator 12 or agitator 14 by either of these agitators being molded around it, a groove 46 being provided for this purpose. A groove 48 is also disposed on the agitator 12 or 14 to provide clearance for the agitator at a bottom plate cross piece 50.

It should be clear from the foregoing description that a novel agitator arrangement has been provided which fulfills the functions of the invention set out. It should further be obvious that only a preferred embodiment has been shown and that many modifications could be made to it which would still fall within the spirit of the invention.

What we claim is:

1. A roll type agitator having brush strips and small, short abbreviated beater bars including;
   (a) said small, short beater bars disposed around said agitator and angled obliquely relative to the axis of the agitator,
   (b) said brush strips angling obliquely relative to the axis of said agitator with said brush strips being partly oriented in one angular direction and partly in the opposite angular direction said oppositely angled brush strips being offset around the periphery of said agitator roll at their contiguous ends,
   (c) said contiguous ends being located at the suction opening of a cleaner supportably mounting said agitator roll,
   (d) said small short beater bars being paired in adjacent obliquely angled, spiralling fashion, and
   (e) said beater bars being angled towards said suction opening.

2. An agitator roll having beater bars;
   (a) said beater bars being short,
   (b) said beater bars angled obliquely relative to the axis of said agitator roll, and
   (c) at least some of said beater bars adjacently in alignment along the axis of the agitator roll.

3. The agitator roll of claim 2 wherein;
   (a) said beater bars spiral around said agiator roll.

4. The agitator roll of claim 2 wherein;
   (a) said beater bars are disposed substantially at an angle of 20° to 25° from the perpendicular to the agitator roll axis.

5. The agitator roll of claim 2 wherein;
   (a) brush strips are provided along said agitator roll,
   (b) said brush strips being disposed at an angle of substantially 20° to 26° from the axis of said agitator roll.

6. An agitator roll having beater bars;
   (a) said beater bars being short and abbreviated,
   (b) said beater bars being angled obliquely relative to the axis of said agitator roll, and
   (c) at least some of said beater bars being grouped at least in pairs and being, within their group, aligned along said agitator axis.

7. The agitator roll of claim 6 wherein;
   (a) said beater bars are angled towards a suction opening of a vacuum cleaner supportably mounting said agitator roll.

8. The agitator roll of claim 7 wherein;
   (a) said agitator includes brush strips angled obliquely relative to said axis of said agitator roll, and
   (b) said brush strips being angled towards said suction opening.

9. The agitator roll of claim 6 wherein;
   (a) said agitator roll and said beater bars are integral and molded of a plastic material.

10. An agitator roll having beater bars;
   (a) said beater bars being relatively short,
   (b) some of said beater bars being angled obliquely relative to the axis of said agitator roll, and some of said beater bars being angled obliquely to said axis in the opposite direction, said beater bars being grouped in alignment parallel to said axis,
   (c) said beater bars angling towards a suction opening for a vacuum cleaner supportably mounting said agitator roll.

* * * * *

UNITED STATES PATENT OFFICE

CERTIFICATE OF CORRECTION

Patent No. 4,349,936 Dated 21 September 1982

Inventor(s) Emmett D. Lorson and Keith G. Minton

It is certified that error appears in the above-identified patent and that said Letters Patent are hereby corrected as shown below:

Column 1, line 12, "shown" should be -- known --.

Column 3, line 3, the spelling of "provide" should be corrected.

Claim 2, line 5, -- being paired -- should be inserted after "bars".

Claim 3, line 2, the spelling of "agitator" should be corrected.

Signed and Sealed this

Twelfth Day of April 1983

[SEAL]

*Attest:*

GERALD J. MOSSINGHOFF

*Attesting Officer* *Commissioner of Patents and Trademarks*